US006207635B1

(12) United States Patent
Adams et al.

(10) Patent No.: US 6,207,635 B1
(45) **Date of Patent: *Mar. 27, 2001**

(54) PROCESS FOR MANUFACTURE OF HIGH DENSITY DETERGENT GRANULES

(75) Inventors: Donald Scott Adams; Bruce Albert Yeazell, both of Cincinnati; Eric Fitzgerald Riddick, West Chester, all of OH (US); Junan Kao, Kobe (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/125,550

(22) PCT Filed: Feb. 29, 1996

(86) PCT No.: PCT/US96/02848

§ 371 Date: Aug. 27, 1998

§ 102(e) Date: Aug. 27, 1998

(87) PCT Pub. No.: WO97/32003

PCT Pub. Date: Sep. 4, 1997

Related U.S. Application Data

(63) Continuation-in-part of application No. 08/455,781, filed on May 31, 1995, now Pat. No. 5,573,697.

(51) Int. Cl.[7] ..... C11D 11/00; C11D 11/04

(52) U.S. Cl. ..... 510/444; 510/359; 510/495; 510/509; 510/510; 264/117; 264/140

(58) Field of Search ..... 510/444, 509, 510/510, 359, 495; 264/117, 140

(56) References Cited

U.S. PATENT DOCUMENTS

| | | | | |
|---|---|---|---|---|
| 3,472,784 | * | 10/1969 | Poe | 510/486 |
| 3,574,119 | * | 4/1971 | Maruta et al. | 510/378 |
| 4,473,485 | * | 9/1984 | Greene | 510/356 |
| 5,164,108 | * | 11/1992 | Appel et al. | 510/444 |
| 5,366,652 | * | 11/1994 | Capeci et al. | 510/444 |
| 5,486,317 | * | 1/1996 | Dorset et al. | 510/444 |
| 5,527,489 | * | 6/1996 | Tadsen et al. | 510/294 |
| 5,573,697 | * | 11/1996 | Riddick et al. | 510/359 |
| 5,576,285 | * | 11/1996 | France et al. | 510/444 |
| 5,633,224 | * | 5/1997 | Porter | 510/444 |
| 5,665,691 | * | 9/1997 | France et al. | 510/444 |
| 5,668,099 | * | 9/1997 | Chapman et al. | 510/444 |
| 5,736,501 | * | 4/1998 | Yamashita et al. | 510/444 |

FOREIGN PATENT DOCUMENTS

| | | | | |
|---|---|---|---|---|
| 0 351 937 A1 | | 1/1990 | (EP) | C11D/11/00 |
| 0353976 | * | 2/1990 | (EP) . | |
| 0 420 317 A1 | | 4/1991 | (EP) | C11D/17/06 |
| 0 555 622 A1 | | 8/1993 | (EP) | C11D/11/04 |
| WO 94/02573 | | 2/1994 | (WO) | C11D/1/02 |
| WO 95/06109 | | 3/1995 | (WO) | C11D/17/06 |

* cited by examiner

*Primary Examiner*—Lorna M. Douyon
(74) *Attorney, Agent, or Firm*—Brian M. Bolam; Kim William Zerby; Steven W. Miller

(57) ABSTRACT

A process for preparing detergent agglomerates is disclosed. The process includes the steps of (a) preparing a mixture of detergent components in a mixer, and (b) agglomerating the mixture from step (a) in a moderate speed mixer to produce detergent agglomerates. The detergent components include (1) from about 20% to about 35% of a surfactant compound selected from the group consisting of anionic surfactants and acid precursors of anionic surfactants; (2) from about 0% to about 65% of a particulate phosphate builder selected from the group consisting of polyphosphate, pyrophosphate, and mixtures thereof; (3) from about 6% to about 60% of a particulate carbonate selected from the group consisting of sodium carbonate, potassium carbonate, and mixtures thereof. Further, when an acid precursor of anionic surfactant is used in (1), the amount of carbonate is at least 2 times that which is sufficient to neutralize the surfactant acid, and at least 40% of the total amount of components (2) and (3) meets a particle size specification of 97% of particles less than 50 microns and median particle size of 5 to 20 microns.

6 Claims, No Drawings

PROCESS FOR MANUFACTURE OF HIGH DENSITY DETERGENT GRANULES

This Application is a continuation-in-part of U.S. application Ser. No. 08/455,781, filed May 31, 1995, now U.S. Pat. No. 5,573,697, dated Nov. 12, 1996.

TECHNICAL FIELD

The invention involves a process for making built high active detergent agglomerates having improved free flow properties.

BACKGROUND OF THE INVENTION

Laundry detergent granules comprise one or more surfactants (usually of the anionic type) and one or more detergency builders (typically phosphates, carbonates, zeolites, etc.) Detergent granules are typically made by preparing a paste of the detergent ingredients, and spray drying the paste to form granules. Such products also can be made by agglomerating a mixture of the surfactant and builder in a mixer. In an agglomeration process, the anionic surfactant in its neutralized form can be used or it can be introduced into the agglomeration process in its acid form and be neutralized in situ by alkaline materials (e.g. sodium carbonate). Optional detergent materials such as brighteners, soil release agents, etc. can be agglomerated along with the surfactant and builder or can be mixed with the agglomerates after they are formed. Generally, agglomeration provides the ability to produce higher density detergent products than those which are produced by spray drying.

A frequent problem with detergent agglomerates, particularly those having a surfactant level of 20% or more, is a tendency to be somewhat sticky (i.e., poor free flow). To help alleviate this problem, flow aids such as clay, talc, zeolites or silica are typically used.

Representative examples of prior patents relating to agglomeration processes for the production of detergent granules are: U.S. Pat. No. 5,133,924 (Appel); U.S. Pat. No. 5,164,108 (Appel); U.S. Pat. No. 5,160,657 (Bartolloti); Brit. Pat. 1,517,713 Unilever); Euro. Appln. 451,894 (Curtis); U.S. Pat. No. 5,108,646 (Beerse et al.); Euro. Pat. Appln. 351,937 (Hollingsworth et al ); and U.S. Pat. No. 5,205,958.

The object of the present invention is to provide a process for producing detergent agglomerates having high surfactant levels and improved free flow characteristics.

SUMMARY OF THE INVENTION

The present invention is directed to a process comprising the steps of:

(a) preparing a mixture of detergent components in a mixer, the said components comprising:

(1) from about 20% to about 35% of a compound selected from the group consisting of anionic surfactants and acid precursors of anionic surfactants;

(2) from about 0% to about 65% particulate phosphate builder selected from the group consisting of polyphosphate, pyrophosphate, and mixtures thereof;

(3) from about 6% to about 60% of a particulate carbonate selected from the group consisting of sodium carbonate, potassium carbonate, and mixtures thereof; wherein when an acid precursor of an anionic surfactant is used in (a)(1), the amount of carbonate is at least 2 times that which is sufficient to neutralize the said acid precursor;

wherein at least about 20% of the total amount of Components (2) and (3) meets a particle size specification of 97% particles less than 50 microns and a median particle size of 5 to 20 microns, and (b) agglomerating the mixture from Step (a) in a second mixer to produce detergent agglomerates.

DETAILED DESCRIPTION OF THE INVENTION

In accordance with the present invention, it has been found that in the preparation of anionic detergent agglomerates having high anionic surfactant content, (i.e., 20% or above) and containing carbonate and, optionally, phosphate builders, improved free flow characteristics can be achieved if at least 20% of the total (i.e., combined) amount of particulate carbonate/phosphate used in preparing the agglomerates meets a specification of 97% particles less than 50 microns and a median particle size of 5 to 20 microns.

Raw Materials

Anionic surfactant is an essential component of compositions prepared by the present process. Such surfactants are well known in the art. The anionic surfactants useful in the subject invention are preferably the alkali metal (i.e., sodium and potassium) salts of alkylbenzene sulfonates or alkyl sulfates or mixtures thereof. Examples of other anionic surfactants which are also useful are the alkali metal salts of paraffin sulfonates, alkyl glyceryl ether sulfonates and alkyl ether sulfates, all having about 8 to about 18 carbon atoms in their alkyl chains. The anionic surfactant raw materials preferably have a moisture content of less than about 1.0%, more preferably less than about 0.5%. Based on the total weight of raw materials added during the process of the subject invention, the amount of anionic surfactant is from about 20% to about 35%, preferably from about 20% to about 30%.

Preferred alkylbenzene sulfonates useful in the subject process include those with an alkyl portion which is straight chain or branched chain, preferably having from about 8 to about 18 carbon atoms, more preferably from about 10 to about 16 carbon atoms. The alkyl chains of the alkylbenzene sulfonate preferably have an average chain length of from about 11 to about 14 carbon atoms. Alkylbenzene sulfonate which includes branched chain alkyl is termed ABS. Alkylbenzene sulfonate which is all straight chain is preferred because it is more easily biodegraded; it is termed LAS.

Preferred alkyl sulfates useful in the subject process include those with an alkyl portion which is straight chain or branched chain, preferably having from about 8 to about 24 carbon atoms, more preferably from about 10 to about 20 carbon atoms, more preferably still from about 12 to about 18 carbon atoms. The alkyl chains of the alkyl sulfates preferably have an average chain length of from about 14 to about 16 carbon atoms. The alkyl chains are preferably linear. Alkyl sulfates are typically obtained by sulfating fatty alcohols produced by reducing the glycerides of fats and/or oils from natural sources, especially from tallow or coconut oil.

Preferred anionic surfactants useful in the subject invention process may also be combinations of alkylbenzene sulfonates and alkyl sulfates, whether mixed together or added during the process separately. Combinations having a ratio of alkylbenzene sulfonate to alkyl sulfate of from about 20:80 to about 80:20 are preferred;. those having a ratio of from about 40:60 to about 60:40 are more preferred. Additional disclosure of anionic synthetic surfactants can be found in U.S. Pat. No. 3,664,961, Norris, issued May 23, 1972, incorporated by reference herein. In practicing the process herein the anionic surfactant can be introduced in its neutralized (i.e., alkali metal) form or it can be introduced in its unneutralized acid precursor form, in which case it is neutralized by excess alkali metal carbonate, as discussed later herein.

Optionally, phosphates are used as builders in compositions made according to the process herein. The phosphate builder raw materials useful in the subject invention process are in particulate form and consist essentially of the water-soluble salts (e.g., the sodium and potassium salts) of polyphosphates (e.g., tripolyphosphate, hexametaphosphate, etc.) or pyrophosphates or mixtures thereof. The phosphate builder raw materials preferably have a moisture content of less than about 2%, more preferably less than about 1%. Based on the total weight of raw materials added during the process of the subject invention, the amount of phosphate builder is typically from about 5% to about 65%, preferably from about 15% to about 55%, more preferably from about 25% to about 45%. Phosphate builder raw materials are typically supplied from their manufacturers in powder form, usually having a median particle size of from about 25 microns to about 50 microns. Carbonate raw materials are typically supplied from their manufacturers in granular form, usually having a particle size of from about 25 microns to about 150 microns. "As is" median particle size for polyphosphate and carbonate varies for supplies obtained in different geographies as well as by supplier. For use in the present invention the polyphosphate builder and/or carbonate are ground to a particle size such that at least about 20% preferably at least about 40% of the total amount of particles of phosphate/carbonate used in the process meet a particle size specification of 97% of particles less than 50 microns (preferably less than 40 microns) and median particle size of 5 to 20 microns, preferably 10 to 20 microns. Either the carbonate, phosphate or both can be ground to achieve the specified amount of total phosphate/carbonate particles within the required size requirements. Preferably at least 40% and more preferably at least 70% of the particles should meet the required specification. Typically, all of the particles of phosphate and carbonate used in the process will be within an overall size range of 5 to 300 microns. Grinding can be accomplished in conventional powder grinding equipment such as an ACM Classifier Mill (Hosokawa Micron Powder Systems). During grinding, or after grinding, if necessary, the particles are classifed to assure that the ground particles to be used are within the required specification. For classification, a Micron Pulsaire Classifier (Hosokawa Powder Systems) can be used.

A preferred phosphate builder useful in the subject process is sodium tripolyphosphate (STPP); STPP can be obtained commercially from, for example, FMC Corp. Another preferred phosphate builder is tetrasodium pyrophosphate (TSPP); TSPP can be obtained commercially from, for example, FMC Corp.

The subject invention process utilizes particulate alkali metal carbonate preferably consisting essentially of sodium carbonate or potassium carbonate or a mixture thereof as builders. If an acid precursor of anionic surfactant is used in the process the carbonate also functions as a neutralizing agent to convert the acid precursor to the alkali metal salt. The alkali metal carbonate raw materials preferably have a moisture content of less than about 2%, more preferably less than about 1%. Based on the total weight of raw materials added to the process of the subject invention, the amount of alkali metal carbonate is from about 6% to about 60%, preferably from about 10% to about 50%, more preferably from about 30% to about 40%.

To neutralize the acid precursor of anionic surfactant, each carbonate ion ($CO_3^{=}$) reacts with two acidic hydrogens ($H^+$). From this reaction, the amount of carbonate needed to theoretically neutralize acid precursor of anionic surfactant can be determined. When an acid precursor of anionic surfactant is used in the process, the amount of carbonate fed to the process is at least about 2 times that theoretically needed to neutralize the acid. Preferably the amount of carbonate will be from about 4 times to about 12 times, more preferably still from about 6 times to about 12 times, the amount needed to neutralize the acid precursor.

In the subject invention process, substantially the only water present in the materials as they go through the process is the minor amounts of moisture present in the raw materials and the water generated by neutralization of acid precursor of anionic surfactant. Throughout the process, the maximum amount of water in the materials being processed is preferably about 10%, more preferably about 7%, more preferably still about 5%, still more preferably about 3%. The detergent agglomerates produced by the process may be somewhat hygroscopic and pick up moisture from the atmosphere.

The detergent agglomerates from the process of the subject invention typically have an average particle size of from about 200 microns to about 800 microns, more preferably from about 300 microns to about 700 microns, more preferably still from about 400 microns to about 600 microns.

An advantage of the process of the invention is that the use of flow aids such as silicas, clays, diatomaceous earth, aluminosilicates (e.g., zeolites), perlite, and calcite can be substantially reduced or eliminated.

Process Steps

The subject invention can be carried out in a continuous or batch manner. Continuous processing is preferred. A description of the subject process conducted in a continuous manner is as follows:

The first step of the process is preferably carried out in a high-speed, high-shear mixer. Suitable mixers for this step include, for example, the Loedige CB®, the Shugi Granulator®, and the Drais K-TT®. The preferred mixer for the first step is the Loedige CB®. Typically, the high-speed mixer has a substantially cylindrical mixing chamber which is from about 0.3 m to about 1 m in diameter and from about 1 m to about 3.5 m in length. Preferred mixers for the first step have a central shaft, with mixer blades attached, which preferably rotates at a speed of from about 300 rpm to about 1800 rpm, more preferably from about 350 rpm to about 1250 rpm, more preferably still from about 400 rpm to about 1000 rpm, the speed generally being lower for larger mixers. The high-speed mixer preferably is water-jacketed to permit cooling water to flow through the mixer jacket, in order to remove heat generated by the neutralization reaction.

For the first step of the subject process, the essential raw materials (i.e., surfactant or surfactant acid precursor; carbonate; and phosphate, if used) are typically fed to the high-speed mixer near one end of the cylindrical chamber and intimately mixed as they proceed through the chamber; the mixture is discharged near the other end of the cylindrical chamber. The typical average throughput rate is from about 0.2 kg/sec to about 17 kg/sec, especially from about 2 kg/sec to about 13 kg/sec, the higher throughput rates generally being achieved using larger mixers. The average residence time of materials in the first-step mixer is preferably from about 2 seconds to about 30 seconds, more preferably from about 5 seconds to about 20 seconds, more preferably still from about 10 seconds to about 15 seconds.

When using acid precursor of anionic surfactant, much of the neutralization of the acid by the carbonate occurs in the first step of the process. Preferably, substantially all of the neutralization takes place in the first step. However, the neutralization reaction may be completed after the mixture discharges from the first-step mixer. The acid is substantially completely neutralized during the process. Cooling water at a temperature of from about 5° C. to about 25° C. is preferably fed to the water jacket of the high-speed mixer. The temperature of the mixture at the discharge from the high-speed mixer is typically from about 35° C. to about 70° C., preferably from about 45° C. to about 55° C.

The materials discharged from the first-step mixer are typically fed substantially immediately into the second-step mixer. The average residence time for materials between the mixers is preferably less than about 5 minutes, more preferably less than about 1 minute.

The second step of the process of the subject invention is preferably carried out in a moderate-speed mixer. Suitable mixers for this step include plowshare mixers, for example, the Loedige KM® and the Drais K-T®. The Loedige KM® is the preferred mixer for the second step of the subject invention process. Typically, the moderate-speed mixer has a substantially cylindrical mixing chamber which is from about 0.6 m to about 2 m in diameter and from about 2 m to about 5 m in length. The preferred mixers have a central shaft, with mixer blades attached, which preferably rotates at a speed of from about 40 rpm to about 160 rpm, more preferably from about 45 rpm to about 140 rpm, more preferably still from about 50 rpm to about 100 rpm, the speed generally being lower for larger mixers. The moderate-speed mixer preferably is water-jacketed to permit water to flow through the mixer jacket, in order to maintain the temperature of product in the moderate-speed mixer at about its incoming temperature.

For the second step of the subject process, the mixture of materials discharged from the first-step mixer is typically fed to the moderate-speed mixer near one end of the cylindrical chamber, mixed as it proceeds through the chamber, and discharged near the other end of the cylindrical chamber. Typically, the throughput rate for the second step is the same as for the first step. The average residence time of the materials in the second-step mixer is preferably from about 0.5 minutes to about 10 minutes, more preferably from about 0.5 minutes to about 5 minutes, more preferably still from about 1 minute to about 4 minutes.

The temperature of the mixture at the discharge of the moderate-speed mixer is typically from about 35° C. to about 70° C., preferably from about 45° C. to about 55° C.

The agglomerates produced by the process herein can be used "as is" for detergent purposes. However other materials normally included in detergent compositions can be included in the agglomerates Mr se or combined with the agglomerates in one or more subsequent mixing steps. Such materials include organic polymeric builders such as polycarboxylates (see U.S. Pat. No. 4,144,226 Diehl), phosphonic acid builders such as disclosed in U.S. Pat. Nos. 3,159,581; 3,213,030; 3,422,021; 3,442,137; 3,400,176; and 3,400,148, alkali metal silicates, zeolite builders as disclosed in U.S. Pat. No. 4,605,509, bleaches, bleach activators, soil suspending agents, enzymes, perfumes, chelating agents, and additional surfactants such as alkyl polyethoxylates, ethoxoylated fatty amines, etc.

All percentages and ratios set forth in this document are "by weight" unless specified otherwise. All patents and patent applications identified herein are incorporated by reference.

The invention will be illustrated by the following example which is not to be construed as limiting the invention in any way.

EXAMPLE I

In this Example, the following agglomerated compositions were prepared.

| | A | B |
|---|---|---|
| Sodium alkylbenzene sulfonate | 27.5%* | 27.5%* |
| Sodium carbonate | 40.0** | 32.0*** |
| Tripolyphosphate | 21.9 | 19.6 |
| Sodium sulfate | 0.6 | 0.7 |
| Zeolite | 7.2 | 15.2 |
| Mosture | 1.9 | 4.7 |
| Miscellaneous | to 100 | to 100 |

*26.5% as unneutralized alkylbenzene sulfonic acid.
**44% prior to neutralization of alkylbenzene sulfonic acid.
***36% prior to neutralization of alkylbenzene sulfonic acid.

Compostion A was made according to the process of the present invention, utilizing acid precursor of the alkylbenzene sulfonate surfactant. A Loedige CB mixer was used in Step 1 and a Loedige KM mixer in Step 2. All materials were added in Step 1, except that 20% of the zeolite (i.e., 1.44 parts) was added in Step 2. All of the sodium carbonate which, "as received" had a particle size of 97% less than approximately 200 microns and a median particle size of 50 microns was ground and classified to meet a specification of 97% less than 40 microns and a median particle size of 10 microns. The tripolyphosphate had an "as received" particle size of 97% less than 200 microns and a median particle size of 50 microns. The tripolyphosphate was not ground and classified prior to use. Thus, 44 parts carbonate which is 67% of the total amount phosphate and carbonate used to prepare the composition was pretreated to meet the particle size specification required by the invention.

Composition B was made in the same manner as Composition A, except that both the carbonate and phosphate were used with their "as received" particle size. Also, in Composition B, 90% of the zeolite was added in Step 1 and 10% (i.e., 1.52 parts) was added in Step 2.

Composition A had excellent free flow characteristics, whereas Composition B had poor free flow characteristics.

Both compositions were subjected to an "arch test". In this test the ability of an agglomerate product to form an arch under pressure can be used to determine potential flowability problems in conveying equipment and storage silos. In this test the agglomerate product is pressed into the form of an arch in a cylindrical vessel, and the stickiness of the product is assessed by measuring the force required to break the arch. The stickier the product, the greater the force required. 1.5 kg force was required for Composition A and 3–5 kg was required for Composition B.

What is claimed is:

1. A process for preparing free flowing detergent agglomerates comprising the steps of:

(a) preparing a mixture of detergent components in a mixer, said components comprising:

(1) from about 20% to about 35% by weight of a surfactant compound selected from the group consisting of anionic surfactants and acid precursors of anionic surfactants;

(2) from about 0% to about 65% by weight of a particulate phosphate builder selected from the group consisting of polyphosphate, pyrophosphate, and mixtures thereof;

(3) from about 6% to about 60% by weight of a particulate carbonate selected from the group consisting of sodium carbonate, potassium carbonate, and mixtures thereof, wherein when an acid precursor of anionic surfactant is used in (a)(1), the amount of carbonate is at least 2 times that which is sufficient to neutralize the surfactant acid;

wherein at least 67% by weight of the total amount of Components (a)(2) and (a)(3) meets a particle size specification of 97% of particles less than 40 microns and median particle size of 5 to 20 microns; and (b) agglomerating the mixture from Step (a) in a moderate speed mixer to produce detergent agglomerates.

2. The process of claim 1 wherein the amount of Component (a)(1) is from about 20% to about 30% by weight.

3. The process of claim 1 wherein the amount of Component (a)(2) is from about 5% to about 65% by weight.

4. The process of claim 1 wherein Component (a)(1) is an acid precursor of an anionic surfactant and the amount of Component (a)(3) is from about 4 to about 12 times the amount needed to neutralize Component (a)(1).

5. The process of claim 1 wherein Component (a)(1) is an acid precursor of an anionic surfactant, the amount of component (a)(1) is from about 20% to about 30% by weight and the amount of Component (a)(2) is from about 15% to about 55% by weight, and the amount of Component (a)(3) is from about 4 to about 12 times the amount needed to neutralize Component (a)(1).

6. The process of claim 1 wherein at least 70% by weight of the total amount of Components (a)(2) and (a)(3) meet said particle size specification.

* * * * *